United States Patent [19]

Epply

[11] 4,206,916

[45] Jun. 10, 1980

[54] TENSIONED NET

[76] Inventor: William R. Epply, P.O. Box 2133, Dillon, Colo. 80453

[21] Appl. No.: 909,394

[22] Filed: May 25, 1978

[51] Int. Cl.[2] ..... A63B 69/40

[52] U.S. Cl. ..... 273/29 A; 273/127 C; 273/26 A; 160/374; 38/102.5

[58] Field of Search ..... 273/26 A, 29 A, 29 R, 273/29 B, 181 R, 181 F, 181 K, 181 I, 181 J, 127 R, 127 B, 127 C; 160/372, 373, 374, 374.1, 378, 379, 381; 38/102.1, 102.4, 102.5, 102.91

[56] References Cited

U.S. PATENT DOCUMENTS

| | | | |
|---|---|---|---|
| 636,812 | 11/1899 | Klemenz | 38/102.5 |
| 1,189,790 | 7/1916 | Carroll | 160/374 |
| 1,565,731 | 12/1925 | Girard | 38/102.4 |
| 2,944,816 | 7/1960 | Dixon | 273/26 A |

*Primary Examiner*—Richard C. Pinkham
*Assistant Examiner*—T. Brown
*Attorney, Agent, or Firm*—James H. Grover

[57] ABSTRACT

A frame for simultaneously tensioning a web in two orthagonal directions including two spaced-apart primary members and two spaced-apart secondary members. Each of the members is disposed at right angles to an adjacent member to form a rectangle. They are linked together in a manner such that upon drawing the two primary members apart, they will simultaneously space the secondary members apart and stretch the web that is disposed therebetween.

5 Claims, 2 Drawing Figures

TENSIONED NET

BACKGROUND OF THE INVENTION

This invention relates to frames and particularly to those which can be used for a rebound web or net for sport balls such as pitch and catch with a baseball, squash, paddle tennis, and especially court and lawn tennis.

SUMMARY OF THE PRIOR ART

In the past, rebound nets have been devised for aiding in playing tennis. For example, my U.S. Pat. No. 3,456,945 describes a net which has been stretched upon a frame so that the ball will be sharply rebounded when it is served.

I have found that it is difficult to achieve maximum tension on a net at all times and in all directions when using a frame having rigidly associated members. Over a period of time, the net will stretch and the tension will decrease. While it is possible to tighten and tie the individual strings of the net upon the frame to compensate for this stretching, the task is quite time consuming.

SUMMARY OF THE INVENTION

I have discovered a frame which can be adjusted to simultaneously tighten the web in two orthagonal directions thereby compensating for any stretch that may occur during use. According to my invention, a pair of primary members are linked at right angles to a pair of secondary support members that are disposed near the ends thereof. One of the primary members is fixed and the other is adjustable. The periphery of the web is attached to the members and supported thereby. To tighten the web, the primary members are spread apart as much as possible which will simultaneously spread the secondary members due to the linkage that I have devised. As a final step, two adjustable clamps attached to the adjustable primary support members are snapped closed and maximum tension will be attained. When assembled, the primary members are disposed substantially parallel to each other and interlocked by pivots to the two secondary support members, which also are disposed substantially parallel to each other.

In the preferred embodiment, the pivots on the secondary members are spaced apart further than the adjacent pivots on the primary members and the links are inclined outwardly from the primary members. With this arrangement, spacing the primary members with the web in place will tighten the web in one direction and simultaneously, will cause the links to spread the secondary members apart also, thereby stretching the net in an orthagonal direction.

THE DRAWINGS

DESCRIPTION

Figure 1:
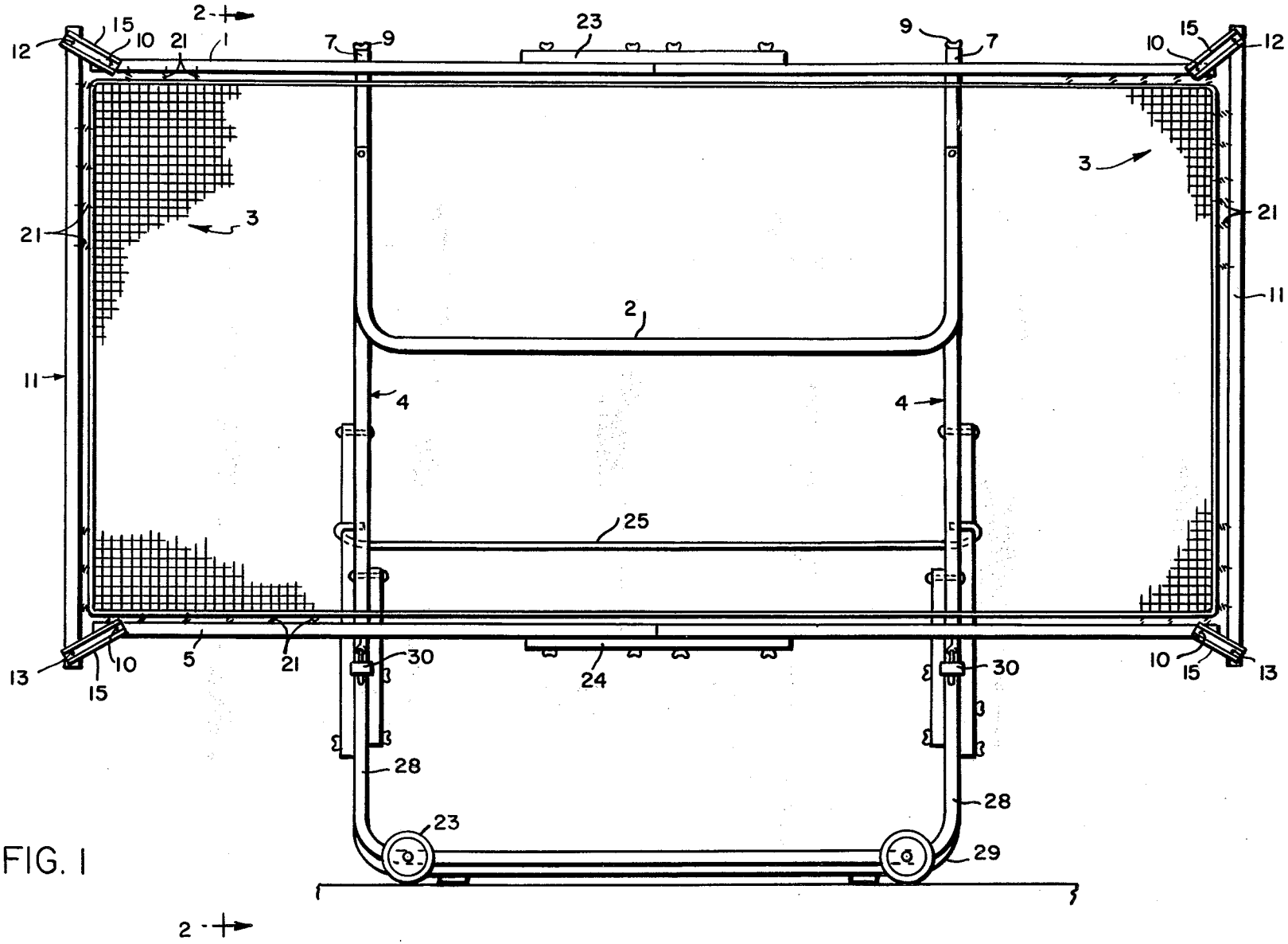
FIG. 1 is an elevational view of the front of the frame, web and standard of my invention.

Referring to FIG. 1, the generally rectangular web 3 is mounted between a pair of primary support members 1 and 5. These support members are, in turn, connected to upper and lower portions of U-shaped brace bars 4, the upper and lower portions extending at right angles to the brace bars 4. Upper support member 1 is fixedly attached to the upper portions of brace 4 and lower support member 5 is adjustably attached to the lower portions braces of 4. Bolts and nuts 9 are fitted through communicating holes in the upper portions 7 of braces 4 and upper support member 1 to fix them together when tightened. A pair of toggle clamps 30 are affixed to the lower portions of the braces 4 and are secured to lower support member 5.

A pair of secondary support members 11 are disposed at substantially right angles to the ends of the primary supports 1 and 5 and held thereto by links 15 which are secured to the respective members of pivots 10, 12 and 13. Web 3 is disposed between the four support members and held at the periphery by springs 21 that are mounted along the inside thereof. Preferably, the pivots 10, 12 and 13 are rivets which have the shanks disposed in holes formed near the ends of the support members. Each of the rivets has one of its heads positioned at the rear of the hole in which it is disposed and is of a sufficient size to prevent the shank from being drawn through. The other head is placed in front of the link 15 and the shank is of a sufficient length to provide for free rotational movement about the pivot point but insufficient to allow for substantial lateral play.

When erected, links 15 extend outwardly from the primary support member 1 and 5 and are attached to the ends of the secondary supports 11 by means of pivots 10, 12 and 13. The links 15 preferably each form an oblique angle relative to the primary supports 1 and 5, and tensioning will produce an even more oblique angle, thereby forcing secondary support members 11 further from each other and hence simultaneously tensioning the web 3 in two orthagonal directions. This simultaneous tensioning is preferably accomplished by spacing the pivots 12 and 13 on the secondary members 11 further apart than the adjacent pivots 10 that are disposed on primary members 1 and 5.

Secure locking of the primary member 5 to the standard with maximum tension placed upon the web 3 can be conveniently accomplished with toggle clamps 30 that are attached to the lower portions 8 of the brace. Hence, when initial tension has been placed upon the net by pulling primary member 5 as much as possible, and attaching primary member 5 to the toggle clamps 30, the toggle clamps 30 can be snapped closed to secure maximum tension on the net. The toggle clamps 30 can be hooked to the primary member 5 by means of eye bolts which are secured thereto. Compression springs can be disposed between the eye bolts and the toggle clamps 30 to urge the primary member 5 towards the toggle clamps 30. The correct rebound angle on the net is adjusted by moving steel rod 25 in catches in legs which support the frame.

One of the important aspects of my invention is that the frame and standard can be disassembled for convenient handling. Primary supports 1 and 5 can be provided in two pieces and held together by braces 23 and 24. When the braces 23 and 24 are removed, member 1 and 5 can be separated into two pieces. In turn, the pieces of upper and lower supports 1 and 5 can then be removed from the standard by unscrewing bolts and nuts 9 and adjustable clamp 30 and the supports will fold into a parallel relationship with secondary supports 11. The standard can be easily dismantled by unbolting horizontal back brace 2 from brace bar 8 and removing steel rod 25. The balance of the standard is collapsible and will fold together to form a fairly compact package.

Figure 2:
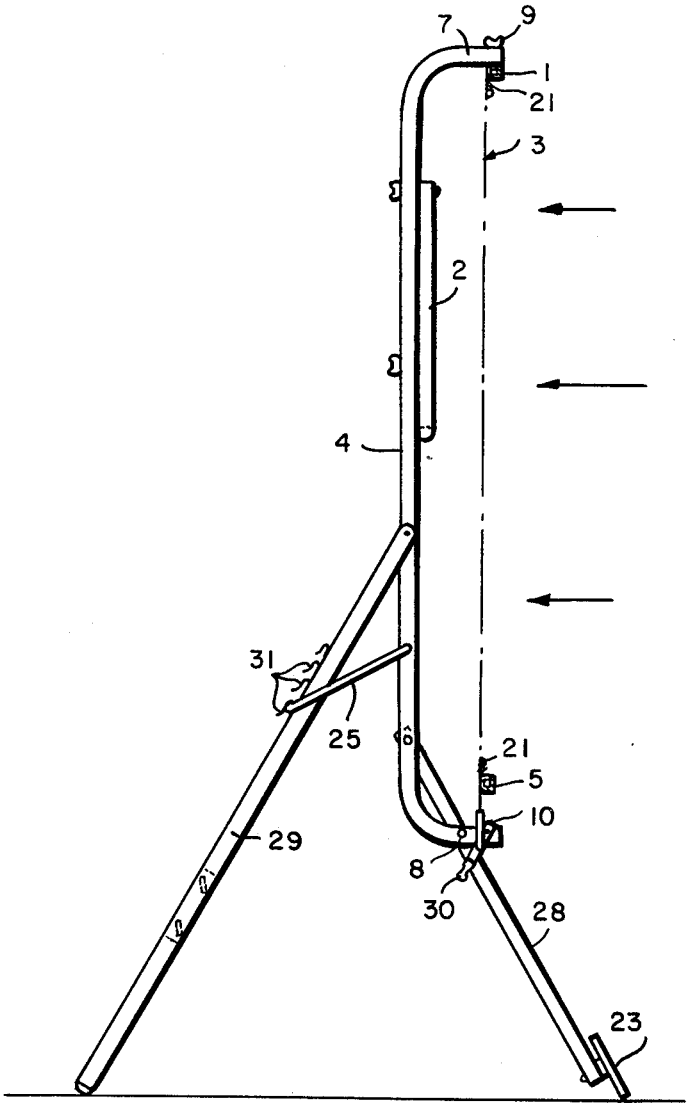
FIG. 2 is a cross-sectional view taken along the lines 2—2 of FIG. 1.

Turning to FIG. 2, it will be seen that the braces 4 are formed in a U-shape with upper portions 7 and lower portions 8 arranged to support the frame and web 3 therebetween. Horizontal back brace 2 provides rigidity to the structure and fixedly separates braces 4 from each other. The lower portions 8 of brace 4 is preferably attached to the toggle clamp 30 which in turn is attached to the lower primary support 5. While in some cases it may be desirable to extend the lower portions 8 of brace 4 and make it one of the legs, in my preferred embodiment however, a wheel leg 28 is attached to the lower brace 8 and secured in a convenient manner to provide, in combination with rear leg 29, a free standing support. Rear leg 29 has a plurality of adjustment catches 31 which can be used, in combination with steel rod 25, to adjust the angle of the web 3.

In the embodiment that is shown, web 3 is fastened to frame 5 by a plurality of springs 21 that are mounted therein. A rope binding is preferably sewn on the perimeter of the web 3 and a plurality of fasteners are disposed around the rope at regular intervals which in turn are attached to a plurality of springs. Many other mechanisms are also available to attach the net to the supports. For example, spring steel flanges may be disposed on the frame and they may be attached to the rope binding. The web 3 is made with any material commonly used for nets such as twisted threads of cotton or nylon rope or even a sheet of canvas, if desired.

It is to be understood that this disclosure is for the purpose of illustration only and that this invention includes all modifications equivalents which fall within the scope of the appended claims.

I claim:

1. Apparatus comprising:

a pair of primary, opposite frame members;

a pair of secondary, opposite frame members, said frame members being disposed to define a substantially rectangular frame;

web means elastically disposed within said frame and attached at its periphery to each member of each of the pairs of frame members;

linking means pivotally attached to each frame member at each corner of the two pairs of members so as to hold the secondary members substantially at right angles to the primary members;

wherein the pivots at the ends of each secondary member are disposed such that increasing the spacing between the primary members swings the linking means so as to increase the spacing between the secondary members, thereby to stretch the web in orthogonal directions.

2. A frame according to claim 1 wherein each linking means is inclined outwardly of the primary members.

3. The frame according to claim 1 wherein each pair of members is substantially parallel to each other.

4. A frame according to claim 1 wherein the pivots at the end of each secondary member are spaced further apart than the adjacent pivots on the primary members.

5. A tennis ball rebound net apparatus comprising:

a frame with a pair of parallel primary horizontal members and a pair of parallel vertical members;

a rectangular net of cords attached around its periphery to the frame members and yieldingly limiting spacing of opposite frame members;

links at the four corners of the net and frame, each link having a pivot attachment to the adjacent ends of the primary and secondary members, the pivots on each vertical member being spaced apart further than the adjacent pivots on the primary members; and a standard with an upstanding support including means attaching one primary member to the support and adjustable means on the support for drawing the other primary member vertically away from said one member so as to swing the linking means in a horizontal direction, thereby to stretch the net in both its orthogonal directions with an unidirectional adjustment.

* * * * *